US010802439B2

(12) United States Patent
Lin

(10) Patent No.: US 10,802,439 B2
(45) Date of Patent: Oct. 13, 2020

(54) PROCESS CARTRIDGE

(71) Applicant: HUIWEI CORPORATION, Zhuhai, Guangdong (CN)

(72) Inventor: Chuanjiang Lin, Guangdong (CN)

(73) Assignee: HUIWEI CORPORATION, Zhuhai, Guangdong (CN)

( * ) Notice: Subject to any disclaimer, the term of this patent is extended or adjusted under 35 U.S.C. 154(b) by 0 days.

(21) Appl. No.: 16/461,414

(22) PCT Filed: Sep. 11, 2017

(86) PCT No.: PCT/CN2017/101157
§ 371 (c)(1),
(2) Date: May 16, 2019

(87) PCT Pub. No.: WO2018/103393
PCT Pub. Date: Jun. 14, 2018

(65) Prior Publication Data
US 2019/0346810 A1 Nov. 14, 2019

(30) Foreign Application Priority Data
Dec. 9, 2016 (CN) ..... 2016 1 1130909

(51) Int. Cl.
*G03G 21/16* (2006.01)
*G03G 21/18* (2006.01)
*G03G 15/08* (2006.01)

(52) U.S. Cl.
CPC ..... *G03G 21/1864* (2013.01); *G03G 15/0812* (2013.01); *G03G 15/0813* (2013.01); *G03G 21/1814* (2013.01); *G03G 2221/1657* (2013.01)

(58) Field of Classification Search
CPC ..... G03G 21/1842; G03G 21/1647; G03G 21/1814; G03G 21/1821; G03G 5/0696
(Continued)

(56) References Cited

U.S. PATENT DOCUMENTS

2006/0034637 A1 2/2006 Kim et al.
2013/0136492 A1* 5/2013 Xu ..... G03G 21/185 399/111
2015/0005134 A1* 1/2015 Shimizu ..... F16H 13/04 476/67

FOREIGN PATENT DOCUMENTS

CN 1734365 A 2/2006
CN 103760757 A 4/2014
(Continued)

OTHER PUBLICATIONS

State Intellectual Property Office of the P.R. China, International Search Report and Written Opinion for International Application No. PCT/CN2017/101157, dated Dec. 14, 2017.

*Primary Examiner* — Walter L Lindsay, Jr.
*Assistant Examiner* — Frederick Wenderoth
(74) *Attorney, Agent, or Firm* — Honigman LLP; Matthew H. Szalach; Jonathan P. O'Brien

(57) ABSTRACT

A process cartridge detachably mountable in an image forming apparatus includes a toner cartridge for accommodating a developer; a developer roller; and a driving force receiving assembly for receiving a driving force of the image forming apparatus and driving the developer roller to rotate; and further includes a first stopper and a second stopper provided at a bottom of the toner cartridge, and the first stopper and the second stopper being movable relative to the toner cartridge in a direction perpendicular to an axial direction of the driving force receiving assembly; and when the first stopper and/or the second stopper move, a driving force receiving head of the driving force receiving assembly is movable in an axial direction of the driving force receiving assembly. The process cartridge can realize separation and contact between a developer roller and an image forming apparatus.

22 Claims, 13 Drawing Sheets

(58) Field of Classification Search
USPC ..... 399/111
See application file for complete search history.

(56) References Cited

FOREIGN PATENT DOCUMENTS

| | | | |
|---|---|---|---|
| CN | 105974755 | A | 9/2016 |
| JP | 2001109356 | A | 4/2001 |
| JP | 2005043538 | A | 2/2005 |

* cited by examiner

PROCESS CARTRIDGE

This application is the national phase of International Application No. PCT/CN2017/101157, titled "PROCESS CARTRIDGE," filed on Sep. 11, 2017, which claims priority to Chinese Patent Application No. 201611130909.4 titled "PROCESS CARTRIDGE", filed with the Chinese State Intellectual Property Office on Dec. 9, 2016, which are incorporated herein by reference in their entirety.

FIELD

The present application relates to a process cartridge used for an image forming apparatus.

BACKGROUND

The process cartridge is a cartridge detachably mounted in the main body of an image forming apparatus, and the process cartridge as an integral unit includes a housing, a photosensitive drum, a developer roller, and the like. The process cartridge is detachable relative to the device host for easy maintenance of the device. The image forming apparatus adopting an electrophotographic image forming manner operates as follows: a photosensitive drum that has been uniformly charged by a charging unit is selectively exposed by light of the image forming apparatus to form an electrostatic latent image, which is developed into a toner image with the toner by the developer roller, and the formed toner image is transferred onto a recording medium by a transfer device, and finally an image is formed on the recording medium.

The process cartridge is mounted in the image forming apparatus, and if the developer roller is in close contact with the photosensitive drum on the image forming apparatus for a long time, the developer roller may contaminate the photosensitive drum on the image forming apparatus, thereby causing print quality defects. In order to solve this problem, it is necessary to separate the developer roller from the photosensitive drum on the image forming apparatus after the development is completed and to bring the developer roller into contact with the photosensitive drum on the image forming apparatus again during development. Since the developer roller needs to receive power from the image forming apparatus, the process cartridge is provided with a driving force receiving assembly, and when the developer roller and the photosensitive drum on the image forming apparatus are separated or contacted, it is necessary to simultaneously separate or engage the developer roller and the driving force receiving assembly and the image forming device.

SUMMARY

An object of the present application is to provide a process cartridge that can realize separation and contact between a developer roller and an image forming apparatus.

In order to realize the above object, the present application adopts the following technical solutions:

a process cartridge detachably mounted in an image forming apparatus, including:

a toner cartridge for accommodating a developer;

a developer roller; and a driving force receiving assembly for receiving a driving force of the image forming apparatus and driving the developer roller to rotate;

wherein the process cartridge further including a first stopper and a second stopper provided at a bottom of the toner cartridge, and the first stopper and the second stopper being movable relative to the toner cartridge in a direction perpendicular to an axial direction of the driving force receiving assembly; and when the first stopper and/or the second stopper move, a driving force receiving head of the driving force receiving assembly is movable in an axial direction of the driving force receiving assembly.

Specifically, when the first stopper or the second stopper moves forward relative to the toner cartridge, the driving force receiving head of the driving force receiving assembly extends outward in the axial direction of the driving force receiving assembly; and when the first stopper or the second stopper moves backward relative to the toner cartridge, the driving force receiving head of the driving force receiving assembly retracts inward in the direction of the driving force receiving assembly.

Specifically, the first stopper is provided on one side wall in the axial direction of the toner cartridge by a rotation shaft, and the side wall of the toner cartridge is further provided with a first locking portion, and a first spring is provided between the first stopper and the toner cartridge, wherein the first spring is in a pre-compressed state, so that the first stopper is abutted against the first locking portion; when there is an external force which makes the first stopper overcomes a pre-compression force of the first spring, the first stopper separates from the first locking portion and rotates forward relative to the toner cartridge about the rotation shaft, and further compresses the first spring.

The second stopper is provided on the other side wall in the axial direction of the toner cartridge by a rotation shaft, and the other side wall of the toner cartridge is provided with a second locking portion, and a second spring is further provided between the second locking portion and the toner cartridge, wherein the second spring is in the pre-compressed state, so that the first stopper is abutted against the second locking portion; when there is the external force which makes the second stopper overcome the pre-compression force of the second spring, the second stopper separates from the second locking portion and rotates forward relative to the toner cartridge about the rotation shaft, and further compresses the second spring.

Specifically, the driving force receiving assembly includes the driving force receiving head, a return spring, a driving block, a driving gear, a positioning bracket, and a position-limiting bracket; the positioning bracket and the driving gear are fixed relative to the toner cartridge in the axial direction of the driving force receiving assembly, and the first stopper is connected to the positioning bracket by a connection rod, and the connection rod drives the positioning bracket to rotate about the axial direction of the driving force receiving assembly;

the position-limiting bracket is provided on the positioning bracket, and the positioning bracket has a pushing protrusion portion protruded in the axial direction of the driving force receiving assembly, and the pushing protrusion portion has a movement slope connecting a top surface of the positioning bracket and the top surface of the pushing protrusion portion, a protrusion portion abutted against the positioning bracket is provided at the bottom of the position-limiting bracket, when the positioning bracket rotates about the axial direction of the driving force receiving assembly, the protrusion portion of the position-limiting bracket moves between the top surface of the positioning bracket and the top surface of the pushing protrusion portion along the movement slope; and the driving block is provided on the position-limiting bracket, and the driving gear is sleeved outside the driving block, and the driving force receiving head passes through the driving gear and the driving block, and extends to the inside of the position-limiting bracket, the return spring is sleeved outside the driving force receiving head, and the return spring has one end abutted against the driving gear, and the return spring has another end abutted against the driving block.

Specifically, the pushing protrusion portion is provided at an outer edge of the positioning bracket.

Specifically, the first stopper and the second stopper, under a pushing of the imaging forming apparatus, drive the toner cartridge and the developer roller to move.

According to the above technical solution, a stopper is provided at the bottom of the toner cartridge by the present application, and the stopper can push the toner cartridge and the developer roller to be in contact with or separate from the photosensitive drum on the image forming apparatus. When the developer roller is in contact with or separated from the photosensitive drum on the image forming apparatus, the stopper controls the driving force receiving head of the driving force receiving assembly of the process cartridge to extend outward or retract inward, so that to engage or disengage with the driving portion of the image forming apparatus. Thereby, after the development is completed, the developer roller and the photosensitive drum on the image forming apparatus can be separated to prevent the developer roller from being in contact with the photosensitive drum for a long time, contaminating the photosensitive drum on the image forming apparatus, and causing print quality defects.

A process cartridge detachably mounted in an image forming apparatus, including:

a toner cartridge for accommodating a developer;

a developer roller; and a driving force receiving assembly for receiving a driving force of the image forming apparatus and driving the developer roller to rotate;

wherein, the process cartridge further including:

a bracket, and the toner cartridge is movably provided at the bracket in an axial direction of the driving force receiving assembly;

a first stopper and a second stopper are provided on the bracket, wherein the first stopper and the second stopper being movable relative to the bracket in a direction perpendicular to the axial direction of the driving force receiving assembly; and when the first stopper and/or the second stopper move, the toner cartridge is movable relative to the bracket in the axial direction of the driving force receiving assembly.

Specifically, when the first stopper and/or the second stopper move, the toner cartridge approaches to or moves away from a power portion of the image forming apparatus relative to the bracket in the axial direction of the driving force receiving assembly.

Specially, when the first stopper and/or the second stopper move forward relative to the toner cartridge, the toner cartridge approaches the power portion of the image forming apparatus in the axial direction of the driving force receiving assembly; and when the first stopper and/or the second stopper move backward relative to the toner cartridge, the toner cartridge moves away from the power portion of the image forming apparatus in the axial direction of the driving force receiving assembly.

Specifically, a toner cartridge movable spring is provided between at least one side wall of the toner cartridge and the bracket, and the toner cartridge movable spring enables the toner cartridge to approach to or move away from the power portion of the image forming apparatus.

Specifically, the first stopper is connected with a first pendulum rod, and the first stopper and the first pendulum rod are connected with one side wall in the axial direction of the bracket by the rotation shaft, a first spring is provided between the first stopper and the toner cartridge, and two ends of the first spring are respectively abutted against the first stopper and the bracket; and the second stopper is connected with the second pendulum rod, and the second stopper and the second pendulum rod are connected with the other side wall in the axial direction of the bracket by the rotation shaft, a second spring is provided between the second spring and the bracket, and two ends of the second spring are respectively abutted against the second stopper and the bracket.

Specifically, a first gap is provided between the side wall of the bracket provided with the first stopper and the side wall of the toner cartridge on the same side; a second gap is provided between the side wall of the bracket provided with the second stopper and the side wall of the toner cartridge on the same side; and when the first stopper rotates, the first pendulum rod is driven to wedge into or exit the first gap, and when the second stopper moves, the second pendulum rod is driven to wedge into or exit the second gap.

Specifically, when the first pendulum rod wedges into the first gap, the second pendulum rod exits the second gap; and when the second pendulum rod wedges into the second gap, the first pendulum rod exits the first gap.

Specifically, the process cartridge further includes a toner cartridge displacement control assembly which is provided between the side wall of the toner cartridge and the bracket, and the toner cartridge displacement control assembly includes a slider, a first movable rod, a second movable rod and a slider spring;

the slider spring has one end fixed on the bracket, and another end connected to the slider, when there is an external force which makes the slider overcome the elastic force of the slider spring, the slider is movable relative to the side wall of the bracket;

the slider is further connected with a rotation shaft for movable rod, and the first movable rod and the second movable rod are rotatably connected to the rotation shaft for movable rod, one end of the first movable rod away from the rotation shaft for movable rod is in contact with or hinged with the side wall of the toner cartridge, and one end of the second movable rod away from the rotation shaft for movable rod is in contact with or hinged with the bracket; and when the slider drives the rotation shaft for movable rod to move, the included angle between the first movable rod and the second movable rod is changed to drive the toner cartridge to move axially relative to the bracket.

Specifically, when the slider spring is in an initial state, the included angle between the first movable rod and the second movable rod is the smallest; when the slider spring is subjected to an external force to generate a maximum deformation amount, the included angle between the first movable rod and the second movable rod is the largest.

Specifically, the toner cartridge displacement control assembly is provided between the axial side wall of the toner cartridge away from the driving force receiving assembly and the bracket.

Specifically, the toner cartridge movable spring is provided between the axial side wall of the toner cartridge mounted with the driving force receiving assembly and the bracket.

Specifically, the toner cartridge displacement control assembly is provided between two axial side walls of the toner cartridge and the bracket, and the toner cartridge displacement control assembly on the same side of the driving force receiving assembly is a first control assembly, and the toner cartridge displacement control assembly on the opposite side to the driving force receiving assembly is a second control assembly; and when the first movable rod and the second movable rod of the first control assembly are in a state of the largest included angle, the first movable rod and the second movable rod of the second control assembly are in a smallest included angle state; and when the first movable rod and the second movable rod of the first control assembly are in a state of the smallest included angle, the first movable rod and the second movable rod of the second control assembly are in a state of the largest included angle.

Specifically, the first stopper is connected with the first pendulum rod, the second stopper is connected with the second pendulum rod, and the first pendulum rod and the second pendulum rod are respectively connected to the sliders of the toner cartridge displacement control assembly on the corresponding side; when the first stopper rotates, the first pendulum rod is driven to rotate to drive the slider movement of the toner cartridge displacement control assembly on the corresponding side; and when the second stopper rotates, the second pendulum rod is driven to rotate to drive the slider movement of the toner cartridge displacement control assembly of the corresponding side.

Specifically, the second movable rod is integrally formed with the rotation shaft for movable rod to form a T-shaped rod, the vertical rod of the T-shaped rod is the rotation shaft for movable rod, and the end of the transverse rod of the T-shaped rod is hinged to the bracket; the slider is provided with a ferrule which is sleeved on the rotation shaft for movable rod, and the slider drives the rotation shaft for movable rod to move.

Specifically, the rotation shaft for movable rod is fixedly provided on the slider and moves with the slider; one end of the second movable rod is sleeved on the rotation shaft for movable rod and rotatable about the rotation shaft for movable rod; and one end of the first movable rod is sleeved on the rotation shaft for movable rod and rotatable about the rotation shaft for movable rod.

Specifically, the axis of the rotation shaft for movable rod is perpendicular to the axis of the driving force receiving assembly and perpendicular to the moving direction of the slider; and the slider is reciprocally movable in the direction perpendicular to the axial direction of the driving force receiving assembly by the slider spring and an external force.

It can be seen from the above technical solution that the present application includes a bracket and a toner cartridge, and a stopper is provided at the bottom of the bracket, and the stopper may drive the toner cartridge, the developer roller or the photosensitive drum to move under the pushing of the image forming apparatus; the toner cartridge is movable relative to the bracket in the axial direction of the rotation axis of the driving force receiving assembly, so that the driving force receiving assembly can be in contact with or separated from the photosensitive drum on the image forming apparatus, thereby separating the developer roller and the photosensitive drum on the image forming apparatus after the development is completed. The developer roller is prevented from being in contact with the photosensitive drum for a long time, from contaminating the photosensitive drum on the image forming apparatus, and from causing print quality defects.

BRIEF DESCRIPTION OF DRAWINGS

In order to more clearly illustrate the embodiments of the present application, a brief description of the drawings used in this embodiments or the conventional art description will be briefly described below. Obviously, the drawings in the following description are only some embodiments of the present application, and those skilled in the art can obtain other drawings according to the drawings without any creative work.

DETAILED DESCRIPTION

The core of the present application is to provide a process cartridge which can realize separation and contact between the developer roller and the image forming apparatus.

The present application will be described in detail below with reference to the accompanying drawings. When the embodiments of the present application are described in detail, for the convenience of description, the drawings showing the structure of the device will not be partially enlarged according to the general proportion, and the schematic diagram is only an example, which should not intend to limit the scope of protection of the present application. It should be noted that the drawings all adopt a very simplified form and all use non-precision ratios, which are only used to conveniently and clearly assist the purpose of illustrating the embodiments of the present application.

Embodiment 1

Figure 1:
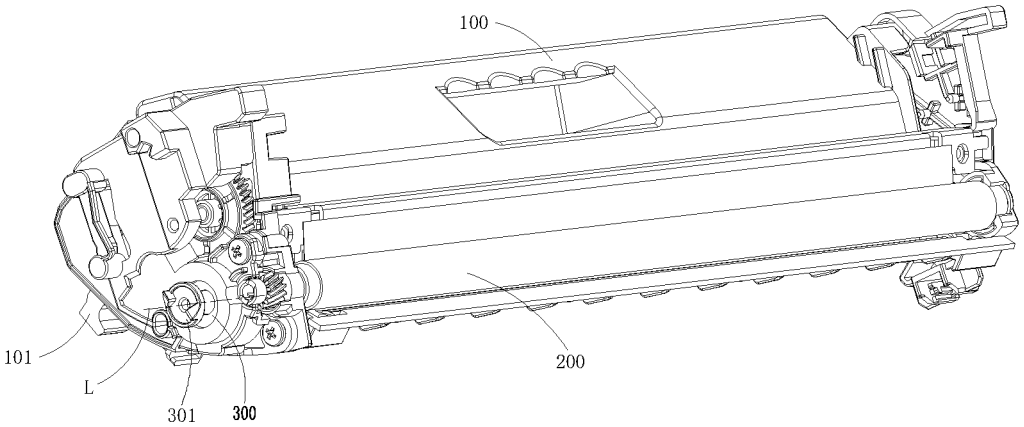
FIG. 1 is a schematic view showing the structure of a process cartridge according to Embodiment 1 of the present application.

As shown in FIG. 1, a process cartridge according to the present application includes a toner cartridge 100 for accommodating a developer and a developer roller 200, and the developer roller 200 may be rotatably provided on the toner cartridge 100 about its own axis, and the process cartridge has two ends provided with end caps. A driving force receiving assembly 300 is provided at one end of the process cartridge, and the driving force receiving assembly 300 receives a driving force coming from an imaging forming apparatus, and drives the developer roller 200 (or a photosensitive drum) to rotate. A first operation assembly and a second operation assembly are respectively provided at the bottom of two ends of the toner cartridge 100, and the toner cartridge and the developer roller are displaced by the first operation assembly and the second operation assembly.

Figure 2:
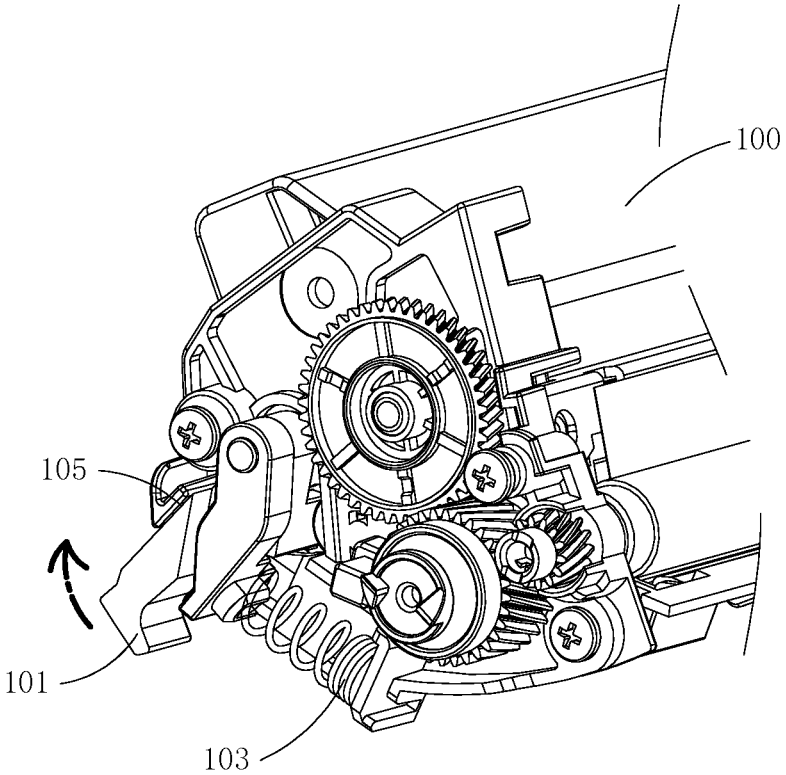
FIG. 2 is a schematic view showing the structure of a first operation assembly according to Embodiment 1.

With reference to FIG. 2, the first operation assembly includes a first stopper 101, a first spring 103 and a first locking portion 105. The first stopper 101 is provided on a side wall of the toner cartridge 100 by a rotation shaft, and may rotate about the rotation shaft in a plane perpendicular to the rotation axis of the developer roller. The first spring 103 has one end abutted against the first stopper 101, and another end abutted against the toner cartridge 100. When the first stopper rotates about the rotation shaft, the first spring 103 may be compressed.

Figure 3:
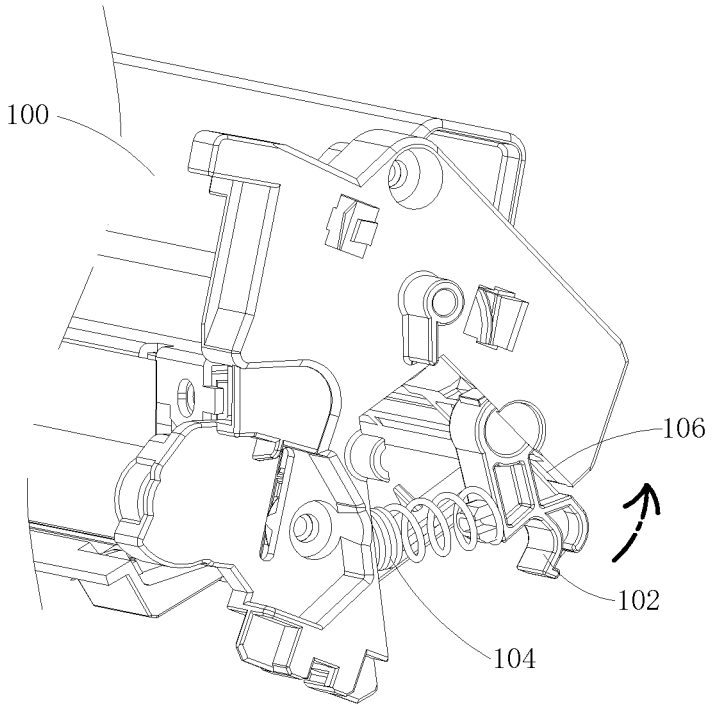
FIG. 3 is a schematic view showing the structure of a second operation assembly according to Embodiment 1.

As shown in FIG. 3, the second operation assembly includes a second stopper 102, a second spring 102 and a second locking portion 106. The second stopper 102 is provided on a side wall of the toner cartridge 100 by the rotation shaft, and may rotate about the rotation shaft on a plane perpendicular to the rotation axis of the developer roller. The second spring 104 has one end abutted against the second stopper 102, and another end abutted against the toner cartridge 100. When the second stopper 102 rotates about the rotation shaft, the second spring 104 may be compressed.

It can be understood that when the first stopper 101 and the second stopper 102 are not rotated, the first spring 103 and the second spring 104 are both in a pre-compressed state, so that the first stopper 101 is in contact with the first locking portion 105 under the elastic force of the first spring 103, and the second stopper 102 is in contact with the second locking portion 106 under the elastic force of the second spring 104. The first locking portion 105 and the second locking portion 106 are provided on the toner cartridge.

That is to say, when there is an external force to rotate the first stopper 101 and the second stopper 102, in fact, the first spring 103 and the second spring 104 may be further compressed.

Figure 4A:
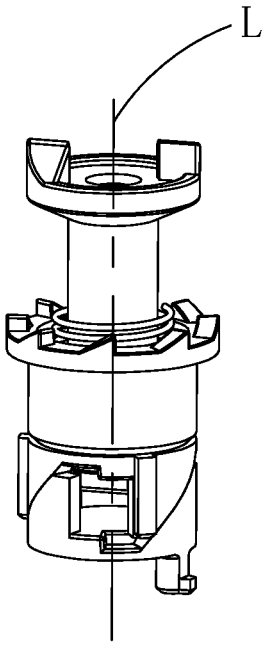
FIG. 4*a* is a schematic view showing the structure of a driving force receiving assembly according to Embodiment 1.
Figure 4B:
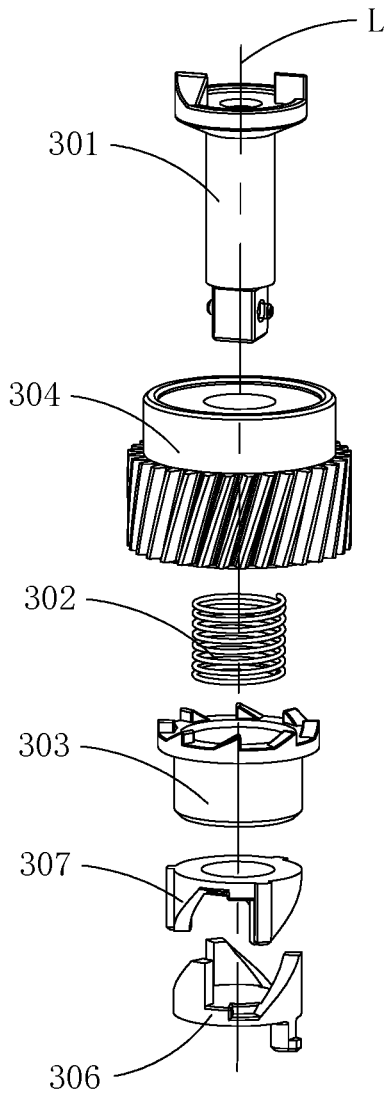
FIG. 4*b* is a schematic view showing the exploded structure of a driving force receiving assembly according to Embodiment 1.

FIGS. 4*a* and 4*b* are the schematic views showing the structure of the driving force receiving assembly. The driving force receiving assembly according to the present embodiment includes a driving force receiving head 301, a return spring 302, a driving block 303, a driving gear 304, a positioning bracket 306 and a position-limiting bracket 307.

Figure 5:
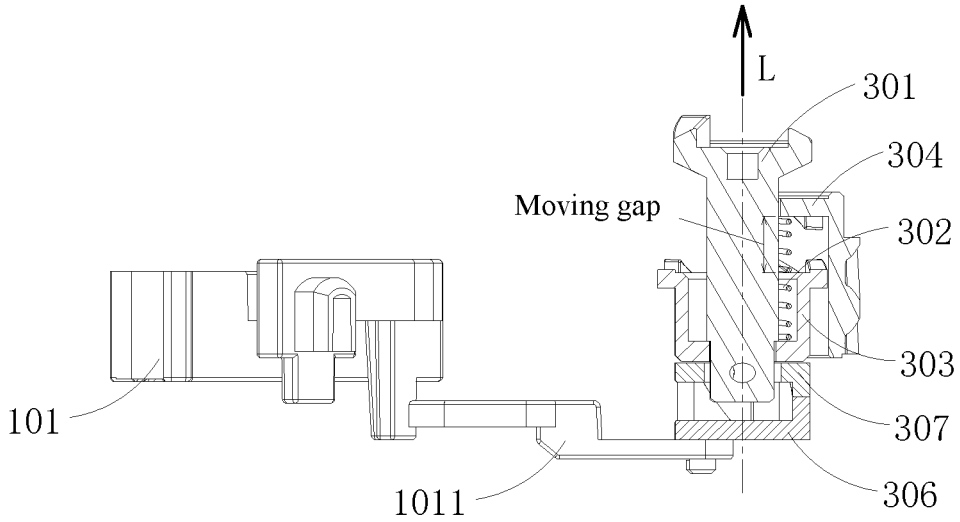
FIG. 5 is a schematic view showing the connection between the first operation assembly and the driving force receiving assembly.

As shown in FIG. 5, the positioning bracket 306 and the driving gear 304 are fixedly provided on the toner cartridge 100 relative to the toner cartridge 100 in the direction of a rotation axis L of the driving force receiving assembly. It can be understood that the rotation axis L is a virtual axis, the direction of which is the axial direction of the driving force receiving assembly, and is also the axial direction of the driving force receiving head 301 and other coaxially provided components. The first stopper 101 is connected with the positioning bracket 306 by a connection rod 1011, and can drive the positioning bracket 306 to rotate about the rotation axis L by the connection rod 1011. The position-limiting bracket 307 is provided on the positioning bracket 306, and transmits the driving force to the developer roller or the photosensitive drum of the process cartridge through the positioning bracket 306.

The positioning bracket 306 has a pushing protrusion portion 306*a* protruding from a surface of the positioning bracket along the rotating axis L. The pushing protrusion portion 306*a* has a movement slope s connecting a top surface of the positioning bracket 306 and a top surface of the pushing protrusion portion 306*a*, and a protrusion portion 307*a* abutted against the positioning bracket is provided at the bottom of the position-limiting bracket 307. When the positioning bracket 306 rotates about the rotation axis L, the protrusion portion 307*a* of the position-limiting bracket 307 is movable between the top surface of the positioning bracket 306 and the top surface of the pushing protrusion portion 306*a* along the movement slope s, so that the position-limiting bracket 307 reciprocally moves along the rotation axis L. As shown in FIG. 4*b*, the pushing protrusion portion 306*a* may be provided at an outer edge of the positioning bracket 306, correspondingly, the protrusion portion 307*a* may be provided at an outer edge of the position-limiting bracket 307.

The driving block 303 is provided on the position-limiting bracket 307, and the driving gear 304 is sleeved outside the driving block 303, and the driving force receiving head 301 passes through the driving gear 304 and the driving block 303. A bottom of the driving force receiving head 301 can extend into the position-limiting bracket 307. The return spring 302 is sleeved outside the driving force receiving head 301, and the return spring 302 has one end abutted against the driving gear 304 and another end abutted against the driving block 303. When the position-limiting bracket 307 moves along the rotation axis L, the driving block 303 and the driving force receiving head 301 are driven to move along the rotation axis L together.

Figure 6:
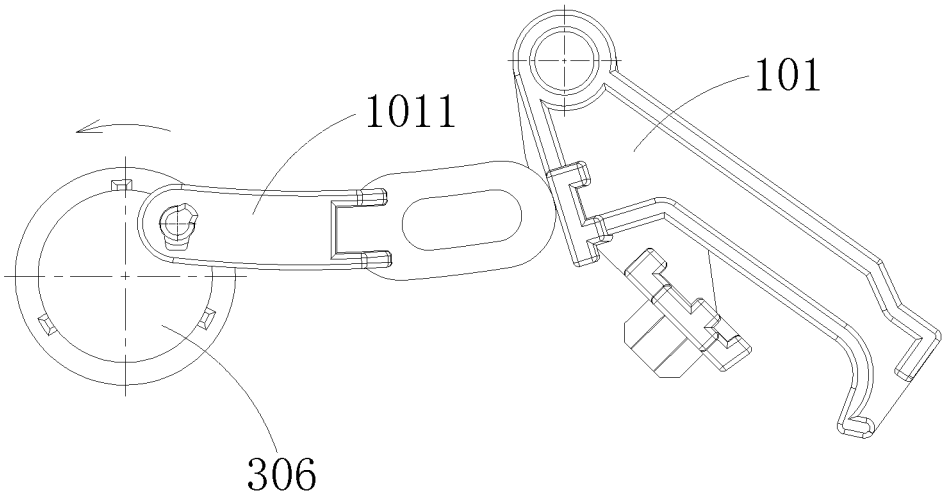
FIG. 6 is a schematic view showing the connection between the first operation assembly and the driving force receiving assembly at another angle.
Figure 7A:
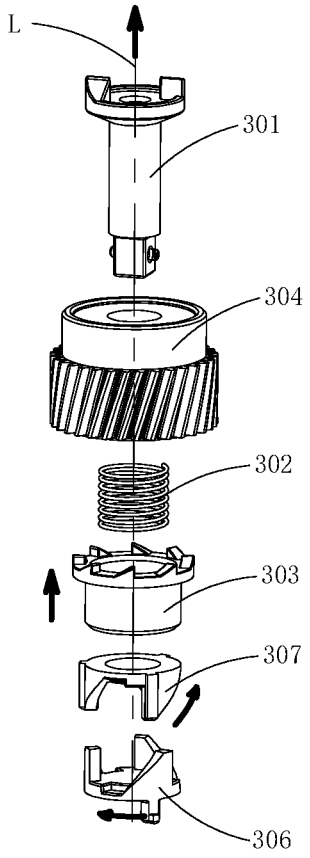
FIG. 7*a* is a schematic view showing the exploded structure of the driving force receiving assembly extending outward.
Figure 7B:
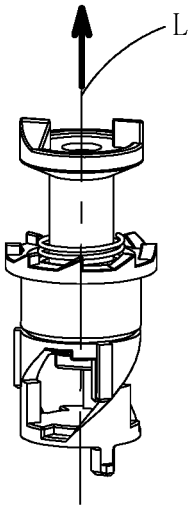
FIG. 7*b* is a schematic view showing the structure of the driving force receiving assembly extending outward.
Figure 8:
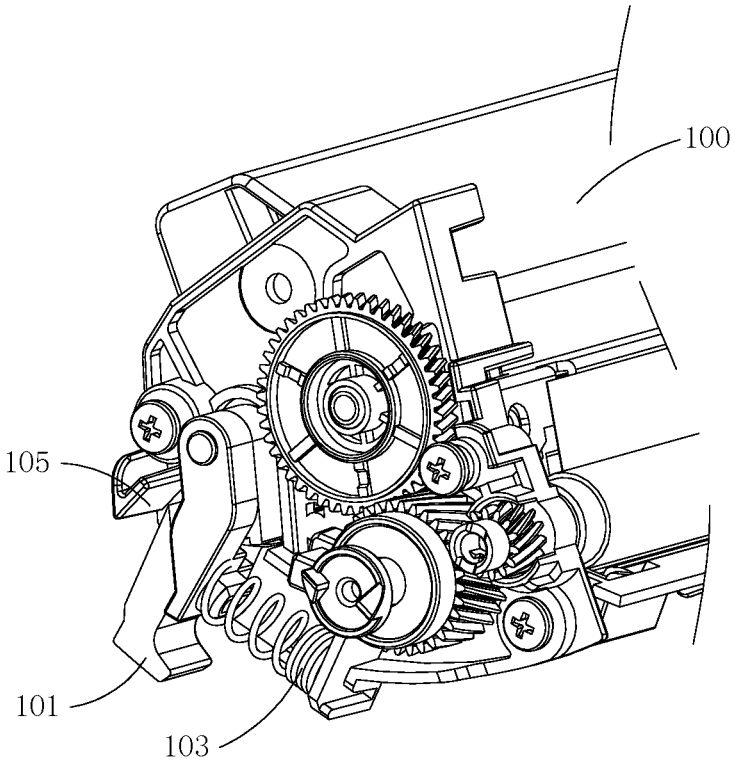
FIG. 8 is a schematic view showing the first operation assembly controlling the driving force receiving head to extend to the maximum position in Embodiment 1.

The operation process during mounting and disassembling of the process cartridge will be described below with reference to FIG. 6, FIG. 7*a* and FIG. 7*b*. For convenience of description, the direction in which the process cartridge is mounted is defined as the front.

As shown in FIG. 2 and FIG. 3, when the process cartridge is mounted in the image forming apparatus and the imaging operation has not been started, the first stopper 101 and the second stopper 102 are in contact with the first locking portion 105 and the second locking portion 106 respectively under the elastic force of the first spring 103 and the second spring 104. At this time, the first stopper 101 controls the positioning bracket 306 at a position where the top surface of the positioning bracket 306 is in contact with the protrusion portion 307*a* of the position-limiting bracket 307 through the connection rod 1011, that is, the driving force receiving head 301 is at the maximum position of retraction.

When the image forming apparatus is ready to image, the image forming apparatus pushes the first stopper 101 and the second stopper 102 to move forward in a direction perpendicular to the rotation axis L, and the toner cartridge 100, the developer roller 200 and the driving force receiving assembly 300 are driven to move forward synchronously by compressing the first spring 103 and the second spring 104 until the developer roller 200 comes into contact with the photosensitive drum provided on the image forming apparatus. The photosensitive drum can be fixedly provided on the image forming apparatus, and can also be mounted on the image forming apparatus in advance.

When the developer roller 200 is in contact with the photosensitive drum provided on the image forming apparatus, since the positions of the toner cartridge and the developer roller are limited and no longer moved, as the image forming apparatus continues to push the first stopper 101 and the second stopper 102, the first stopper 101 and the second stopper 102 start to leave the first locking portion 105 and the second locking portion 106, and the first stopper 101 drives the positioning bracket 306 to rotate about the rotation axis L through the connection rod 1011 while moving. When the positioning bracket 306 rotates, the protrusion portion 307*a* of the position-limiting bracket 307 starts to move from the top surface of the positioning bracket 306 toward the top surface of the pushing protrusion portion 306*a* along the movement slope s, and compresses the return spring 302. With reference to FIGS. 7*a* and 7*b*, during the movement, the position-limiting bracket 307 moves outward along the rotation axis L, so that the driving force receiving head 301 extends outward. When the positioning bracket 306 stops rotating, the position-limiting bracket 307 is located at a position farthest from the top surface of the positioning bracket 306, thereby causing the driving force receiving head 301 to extend to the maximum position, at which time the driving force receiving head 301 can be engaged with a power portion of the image forming apparatus.

After the imaging is finished, since the driving force receiving head 301 is still engaged with the power portion of the image forming apparatus and is not movable, when the image forming apparatus pushes the first stopper 101 and the second stopper to move backward, the first stopper 101 controls the positioning bracket 306 to rotate in a reverse direction by the connection rod 1011. The protrusion portion 307*a* of the position-limiting bracket 307 moves along the movement slope s from the top surface of the pushing protrusion portion 306*a* toward the top surface of the positioning bracket 306 under the elastic force of the return spring 302, and the position-limiting bracket 307 moves toward the positioning bracket 306, and the driving force receiving head 301 is retracted from the extended state to the retracted state until the driving force receiving head 301 returns to the maximum retracted position shown in FIG. 2. At this time, the driving force receiving head 301 can disengage from the power portion of the image forming apparatus, and the first stopper 101 and the second stopper 102 are restored to contact with the first locking portion 105 and the second locking portion. As the image forming apparatus continues to push, the first stopper 101 and the second stopper 102 drive the toner cartridge to move backward to separate the developer roller 200 from the photosensitive drum provided on the image forming apparatus.

Embodiment 2

Figure 9:
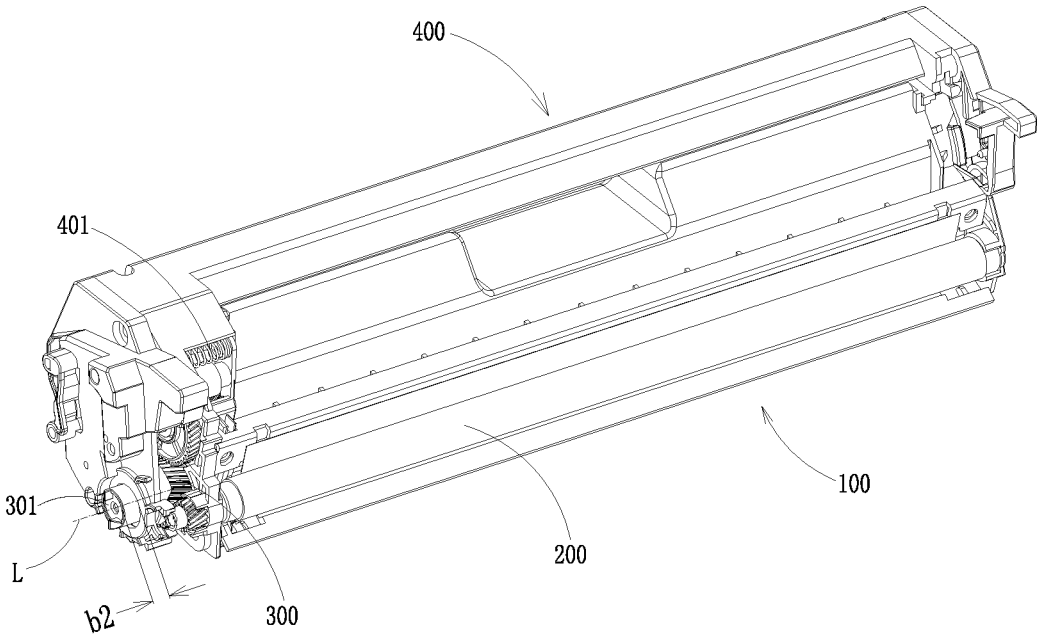
FIG. 9 is a schematic view showing a process cartridge according to Embodiment 2 of the present application.
Figure 10A:
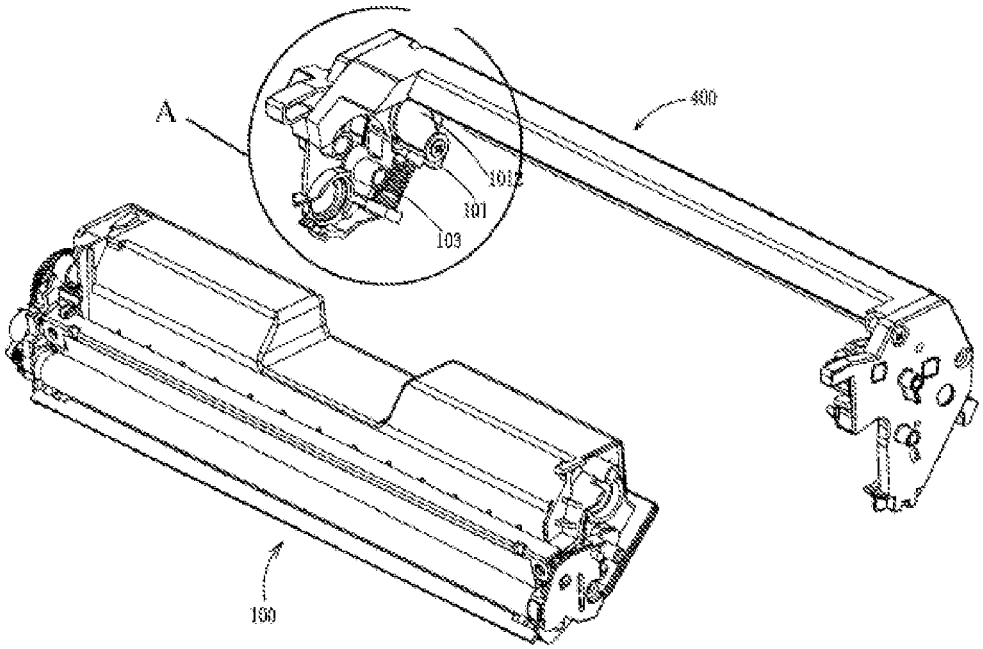
FIG. 10*a* is a schematic view showing exploded structures of a toner cartridge and a bracket.
Figure 10B:
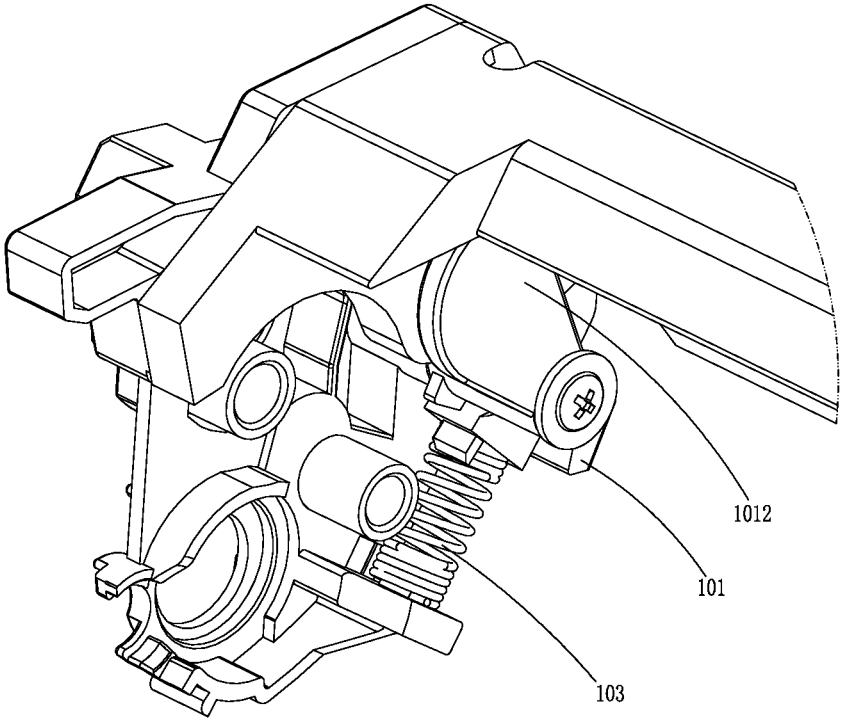
FIG. 10*b* is a partially enlarged schematic view showing the portion A in FIG. 10*a*.
Figure 11A:
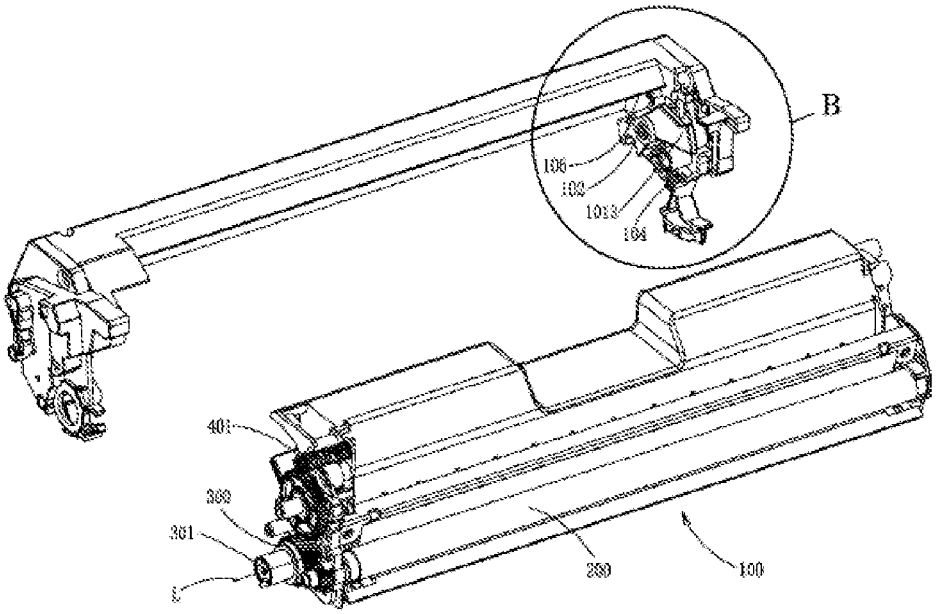
FIG. 11*a* is a schematic view showing exploded structures of the toner cartridge and the bracket at another angle.
Figure 11B:
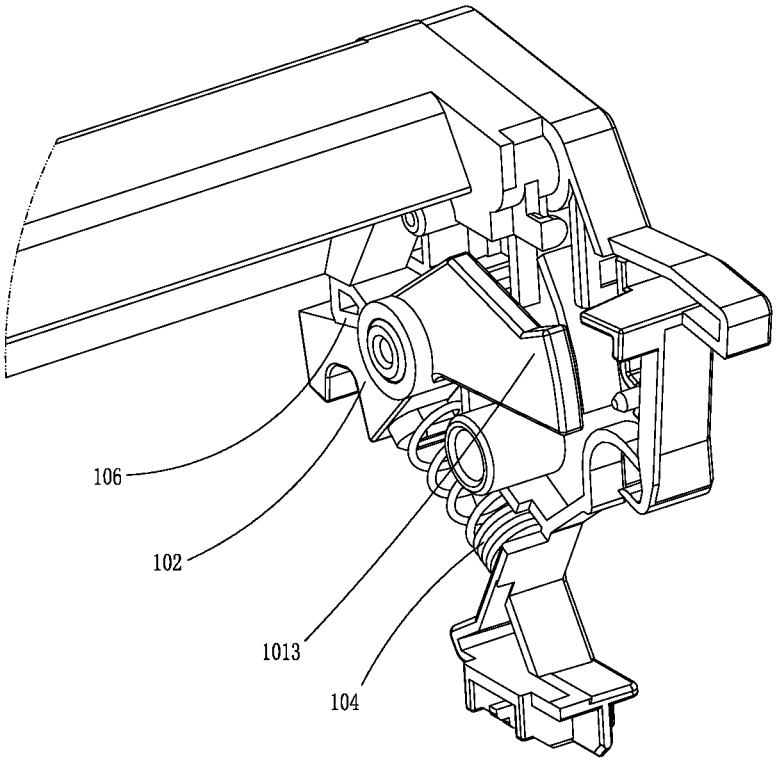
FIG. 11*b* is a partially enlarged schematic view showing the portion B in FIG. 11*a*.

As shown in FIG. 9, a process cartridge according to the present embodiment includes a toner cartridge 100, a developer roller 200 and a bracket 400. The toner cartridge 100 may be movably provided on the bracket 400 along the rotation axis L under an external force, and the bracket is substantially ⊓ shaped. The toner cartridge 100 has one end provided with a driving force receiving assembly 300. A toner cartridge movable spring 401 is provided between one side wall of the toner cartridge 100 and the bracket 400, and two ends of the toner cartridge movable spring 401 are respectively abutted against an inner side wall of the bracket 400 and the side wall of the toner cartridge 100. The toner cartridge movable spring 401 enables the toner cartridge 100 to be away from the power portion of the image forming apparatus. The toner cartridge moveable spring 401 and the driving force receiving assembly in this embodiment are on the same side, but the toner cartridge movable spring may also be provided between the side wall of the toner cartridge without mounting the driving force receiving assembly and the bracket, or may be provided between two side walls of the toner cartridge and the bracket. The driving force receiving assembly in this embodiment includes a driving force receiving head, a driving block and a driving gear. The driving force receiving head, the driving block and the driving gear are fixedly provided on the toner cartridge relative to the toner cartridge in the direction of the rotation axis L.

As shown in FIGS. 10*a*, 10*b*, 11*a* and 11*b*, two ends of the bracket 400 are respectively provided with a first operation assembly and a second operation assembly, wherein the first operation assembly is located on the same side as the drive force receiving assembly 300.

The first operation assembly includes a first stopper 101 (in this embodiment, the first stopper 101, the toner cartridge movable spring 401 and the driving force receiving assembly are on the same side as the bracket), a first spring 103, and a first locking portion 105 (not shown). The first stopper 101 in this embodiment is connected with a first pendulum rod 1012, the first stopper 101 and the first pendulum 1012 are connected with the bracket 400 by a rotation shaft, and the axis of the rotation shaft is parallel to the rotation axis L. The first spring 103 has one end abutted against the first stopper 101, and another end abutted against the bracket 400 in the direction of the side wall of the bracket. The second operation assembly includes a second stopper 102, a second spring 104, and a second locking portion 106. The second stopper 102 in this embodiment is connected with a second pendulum rod 1013, and the second stopper 102 and the second pendulum 1013 are connected with the bracket 400 through a rotation shaft. The second spring 104 has one end abutted against the second stopper 102, and another end abutted against the bracket 400 in the direction of the side wall of the bracket. The first stopper 101 is in contact with the first locking portion 105, and the second stopper 102 is in contact with the second locking portion 106.

In this embodiment, since a gap is provided between the side wall of the bracket and the side wall of the toner cartridge, both the first pendulum rod 1012 and the second pendulum rod 1013 may wedge between the side wall of the bracket and the side wall of the toner cartridge. For convenience of description, the gap between the side wall of the bracket provided with the first stopper and the side wall of the toner cartridge on the same side may be referred as a first gap, and the gap between the side wall of the bracket provided with the second stopper and the side wall of the toner cartridge on the same side may be referred as a second gap. However, the first pendulum rod 1012 and the second pendulum rod 1013 form a reverse motion relationship, specifically, when the second pendulum rod 1013 wedges into the gap (the second gap) between the bracket 400 and the toner cartridge 300, the first pendulum rod 1012 can exit the gap (the first gap) between the bracket 400 and the toner cartridge 300, and vice versa.

When the process cartridge is mounted in the image forming apparatus and the imaging operation has not been started, the toner cartridge 100 is moved away from the power portion of the image forming apparatus under the pushing of the toner cartridge movable spring 401, and the driving force receiving assembly 300 is also away from the image forming apparatus. When the toner cartridge 100 is away from the power portion of the image forming apparatus to the maximum position, the driving head is separated from the power portion, and at this time, the driving force receiving head 301 extends from the outer side wall of the bracket by a length b2, as shown in FIG. 9.

When ready for development, the image forming apparatus pushes the first stopper 101 and the second stopper 102 to move forward in the direction perpendicular to the rotation axis L. The first stopper 101 and the second stopper 102 respectively drive the toner cartridge 100 and the bracket 400 to move forward by a pressure transmission of compressing the first spring 103 and the second spring 104, and the driving force receiving assembly 300 also moves forward synchronously. When the developer roller 200 is in contact with the photosensitive drum provided on the image forming apparatus, the toner cartridge 100 stops moving.

Figure 12:
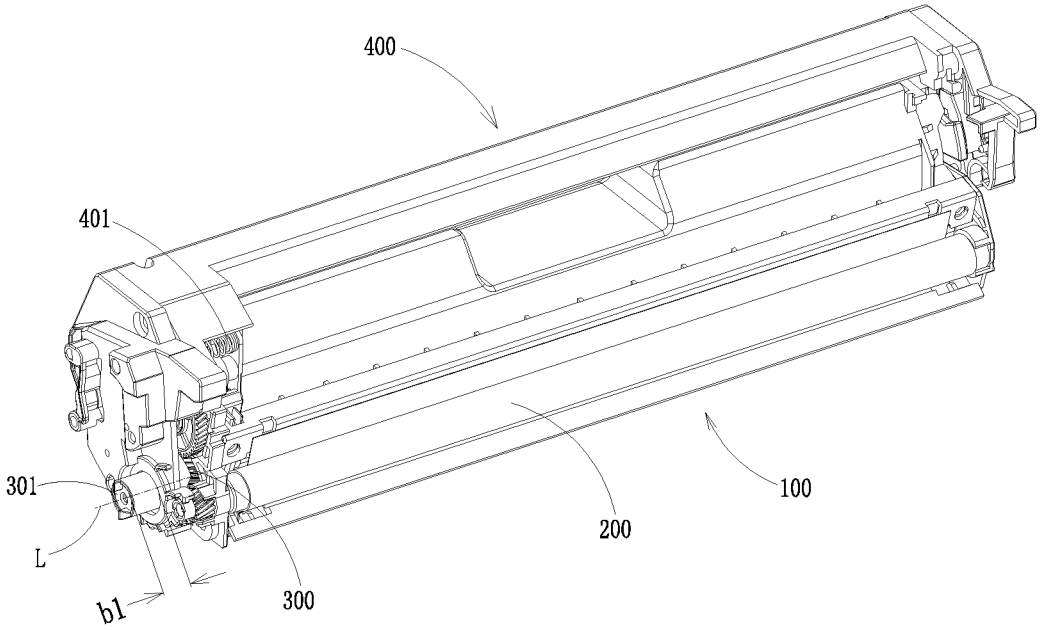
FIG. 12 is a schematic view showing the toner cartridge sliding to the outermost position relative to the bracket in the direction of the rotation axis L.

As the image forming apparatus continues to push the first stopper 101 and the second stopper 102, due to the gap between the side wall of the bracket and the side wall of the toner cartridge, when the first stopper 101 and the second stopper 102 respectively continues to compress the first spring 103 and the second spring 104, the first stopper 101 drives the first pendulum rod 1012 to wedge into the gap between the side wall of the bracket and the side wall of the toner cartridge, and the second stopper 102 drives the second pendulum rod 1013 to exit the gap between the side wall of the bracket and the side wall of the toner cartridge. The first pendulum rod 1012 and the second pendulum rod 1013 enable the toner cartridge 100 to approach to the power portion of the image forming apparatus along the rotation axis L by overcoming the elastic force of the toner cartridge movable spring 401. When the toner cartridge 100 is closest to the power portion of the image forming apparatus, the driving force receiving head 301 extends from the outer side wall of the bracket by a length b1, b1>b2, at which time the driving force receiving head 301 can engage with the power portion on the image forming apparatus (FIG. 12).

After the imaging is finished, when the image forming apparatus pushes the first stopper 101 and the second stopper 102 to move backward, since the driving force receiving head 301 is still engaged with the power portion of the image forming apparatus and is not movable, the first stopper 101 and the second stopper 102 are displaced relative to the toner cartridge 100 in the direction perpendicular to the rotation axis L, so that the first stopper 101 drives the first pendulum rod 1012 to exit the gap between the side wall of the bracket and the side wall of the toner cartridge, the second stopper 102 drives the second pendulum rod 1013 to wedge into the gap between the side wall of the bracket and the side wall of the toner cartridge, so that the toner cartridge movable spring 401 is reset, thereby controlling the toner cartridge 100 to be away from the power portion of the image forming apparatus. When the toner cartridge 100 is away from the power portion of the image forming apparatus to the maximum position, the driving force receiving head 301 and the power portion of the image forming apparatus are disengaged. The first stopper 101 and the second stopper 102 are also restored to be in contact with the first locking portion 105 and the second locking portion 106 respectively. As the image forming apparatus continues to push, the first stopper 101 and the second stopper 102 respectively push the toner cartridge to move backward through the first locking portion 105 and the second locking portion 106, so that the developer roller 200 and the photosensitive drum provided on the image forming apparatus are separated.

In this embodiment, related variations can also be made. For example, the first stopper 101 is not provided with the first pendulum rod 1012, but the second stopper 102 drives the second pendulum rod 1013 to wedge into or exit the gap between the sidewall of the bracket and the side wall of the toner cartridge, so that the toner cartridge movable spring 401 is restored or compressed, thereby further controlling the toner cartridge 100 to move away from or close to the power portion of the image forming apparatus, completing the connection of the driving head and the driving force receiving head. The second stopper 102 may also not be provided with the second pendulum rod 1013, and only the first stopper 101 is provided with the first pendulum rod 1012, and only the first stopper 101 drives the first pendulum rod 1012 to wedge into or exit the gap between the side wall of the bracket and the side wall of the toner cartridge, so that the toner cartridge movable spring 401 is compressed or reset, thereby controlling the toner cartridge 100 to move close to or away from the power portion of the image forming apparatus, and completing the connection between the driving head and the driving force receiving head. The toner cartridge movable spring may also be not provided.

Embodiment 3

Figure 13:
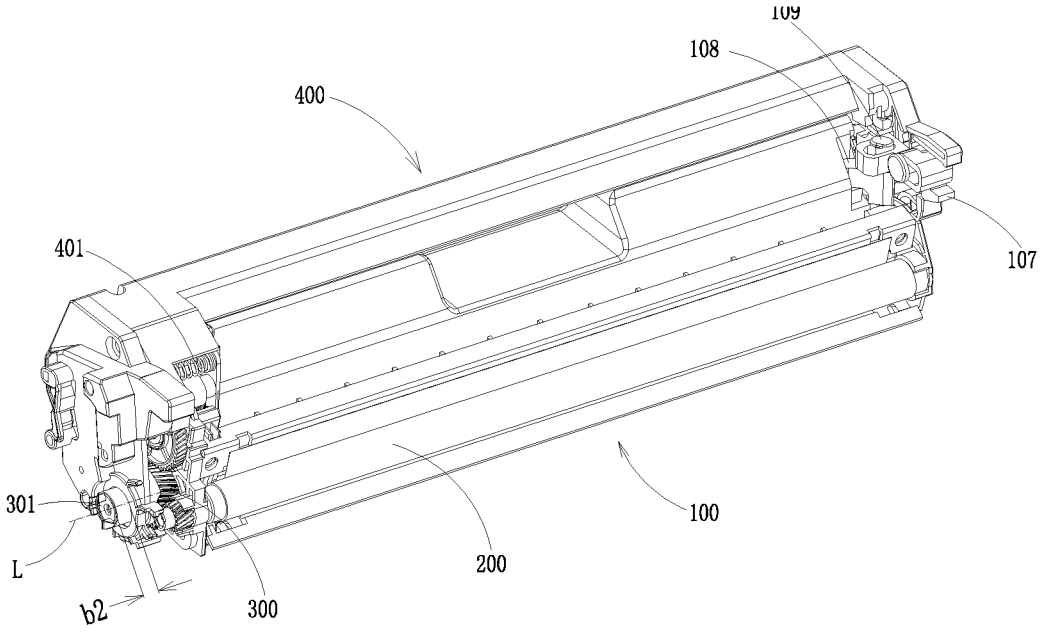
FIG. 13 is a schematic view showing a process cartridge according to Embodiment 3 of the present application.
Figure 14A:
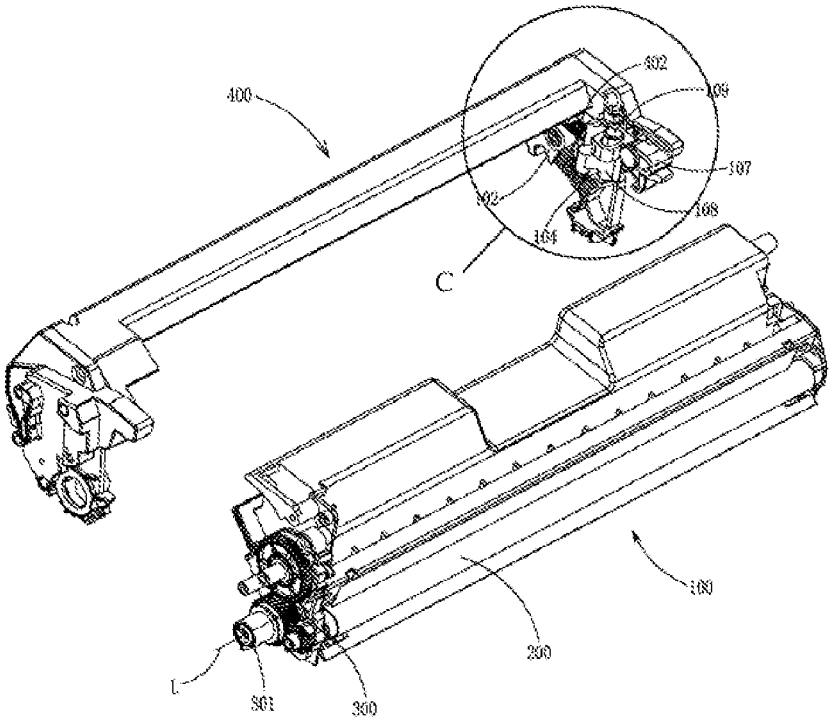
FIG. 14*a* is a schematic view showing exploded structures of a toner cartridge and a bracket.
Figure 14B:
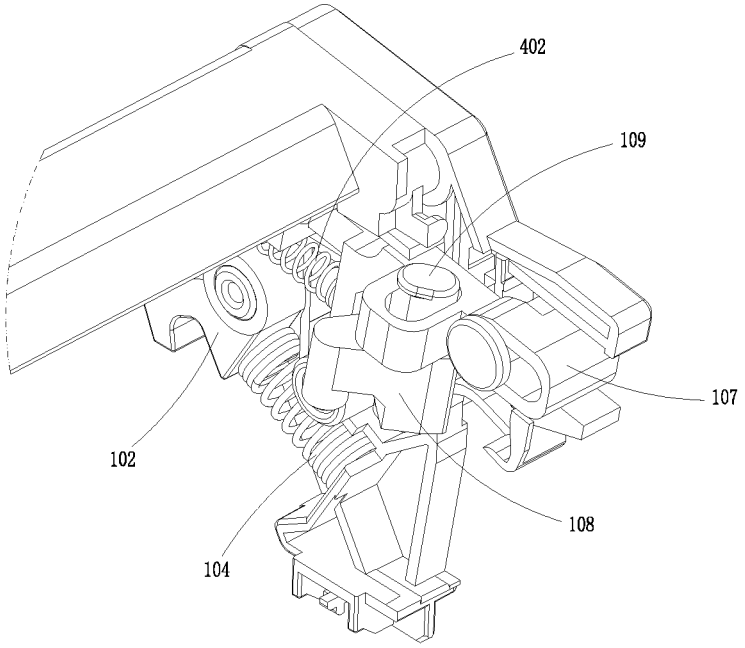
FIG. 14*b* is a partially enlarged schematic view showing a portion C in FIG. 14*a*.

Referring to FIGS. 13, 14*a* and 14*b*, the difference between the present embodiment and the Embodiment 2 is that a toner cartridge displacement control assembly is provided between the toner cartridge side wall where the driving force receiving assembly is not provided and the bracket 400, and the toner cartridge displacement control assembly is used for replacing the first pendulum rod and the second pendulum rod to make the toner cartridge movable spring 401 to be compressed or reset, thereby controlling the toner cartridge 100 to move close to or away from the power portion of the image forming apparatus and completing the connection of the driving head and the driving force receiving head. The toner cartridge displacement control assembly includes a slider 107, a first movable rod 108, a second movable rod 109 and a slider spring 402. The slider spring 402 has one end fixed on the bracket 400, and another end connected to the slider 107, and the slider 107 is movably provided relative to the side wall of the bracket in the direction of the side wall of the bracket. The slider 107 is movable in the direction perpendicular to the rotation axis L under the elastic force of the slider spring 402.

The second movable rod 109 is in a transvers T-shape, and an end of the transverse rod is arranged on the bracket 400 by a hinge, and a vertical rod portion forms a rotation shaft for movable rod. The slider 107 is sleeved on the rotation shaft for movable rod through a ferrule provided on the slider 107 and can drive the rotation shaft for movable rod to move. One end of the first movable rod 108 is sleeved on the rotation shaft for movable rod and rotatable about the rotation shaft for movable rod and the other end (a free end) of the first movable rod 108 is in contact with the side wall of toner cartridge 100. The axis of the rotation shaft for movable rod is perpendicular to the rotation axis L and perpendicular to the moving direction of the slider.

Figure 15A:
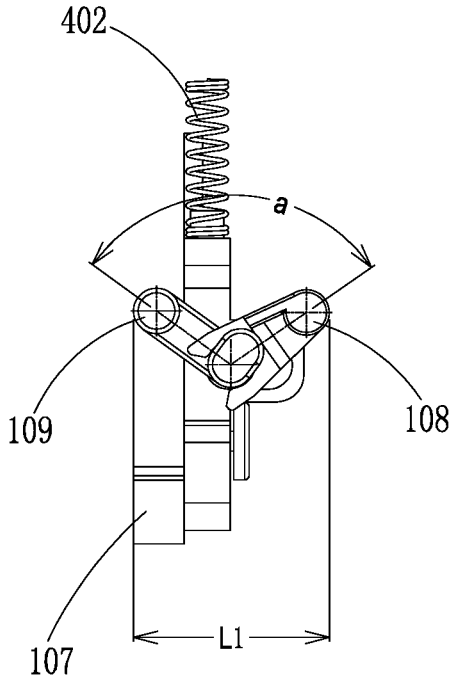
FIG. 15*a* is a schematic view showing the movement of a slider and first and second movable rods when the toner cartridge is farthest from the driving portion of the image forming apparatus
Figure 15B:
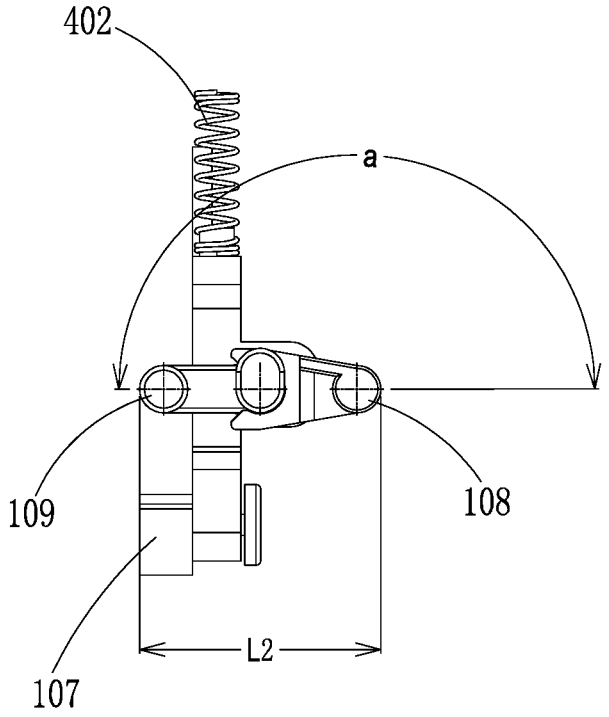
FIG. 15*b* is a schematic view showing the movement of the slider and the first and second movable rods when the toner cartridge is closest to the driving portion of the image forming apparatus
Figure 16:
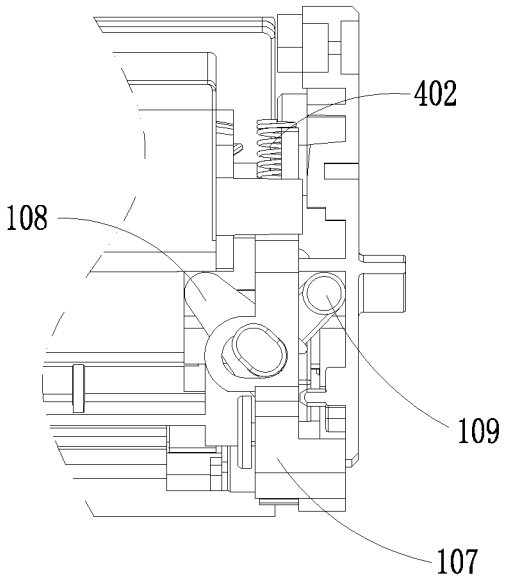
FIG. 16 is a schematic view showing the structures of the slider and the first and second movable rods when the toner cartridge is farthest from a driving portion of the image forming apparatus
Figure 17:
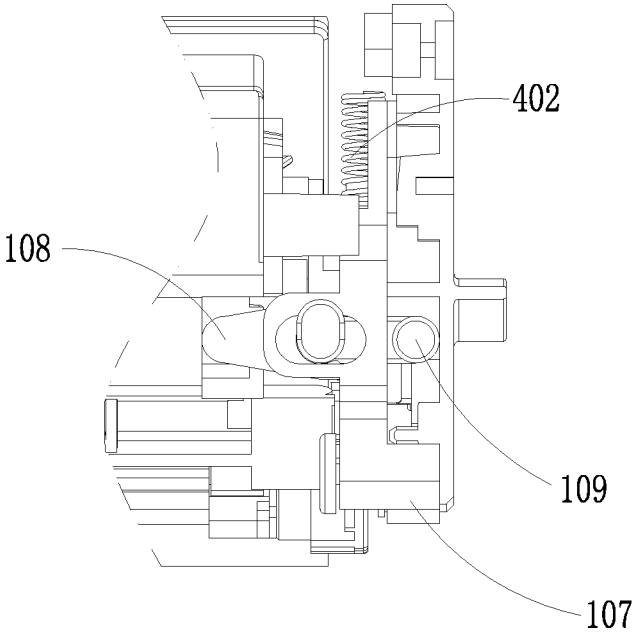
FIG. 17 is a schematic view showing the structures of the slider and the first and second movable rods when the toner cartridge is closest to the driving portion of the image forming apparatus

With reference to FIGS. 15*a*, 15*b*, 16 and 17, the movement relationship between the slider and the first and second movable rods when moving can be understood. Referring to FIGS. 15*a* and 16, when the slider 107 is pushed by the slider spring 402 to the maximum position away from the bracket 400, there is a certain included angle between the transverse rods of the first movable rod 108 and the second movable rod 109, and the distance between two oppositely disposed ends (outer ends) of the first movable rod 108 and the second movable rod 109 is L1. When the slider 107 moves in a direction close to the inner side of the bracket 400, the slider spring 402 is compressed. The slider 107 drives the rotation shaft for movable rod to move by the ferrule, forcing the first movable rod 108 to rotate about the rotation shaft for movable rod, and the included angle between the transverse rods of first movable rod 108 and the second movable rod 109 becomes larger. The distance between two oppositely disposed ends of the transverse rods of the first movable rod 108 and the second movable rod 109 gradually increases with the movement of the slider 107. When the slider 107 reaches the position closest to the rear side of the bracket 400 (away from the toner cartridge), the distance between two oppositely disposed ends of the first movable rod 108 and the second movable rod 109 becomes the largest, which is L2, L2>L1, with reference to FIGS. 15*b* and 17.

When the process cartridge is mounted in the image forming apparatus and the imaging has not been started, the slider 107 is farthest from the bracket 400 under the pushing of the slider spring 402, and the distance between two oppositely disposed ends of the transverse rods of the first movable rod 108 and the second movable rod 109 is the smallest, and the included angle between the transverse rods of the first movable rod 108 and the second movable rod 109 is the smallest; and since there is no external force, the state in which the slider spring 402 is located can be referred as an initial state, that is, the state in which the slider spring 402 is not applied with an external force. At this time, the toner cartridge 100 is located on one side away from the power portion of the image forming apparatus under the pushing of the toner cartridge movable spring 401, and the driving assembly 300 provided on the toner cartridge 100 is also away from the power portion of the image forming apparatus, and the driving force receiving head 301 is separated from the power portion of the image forming apparatus (FIG. 13).

Figure 18:
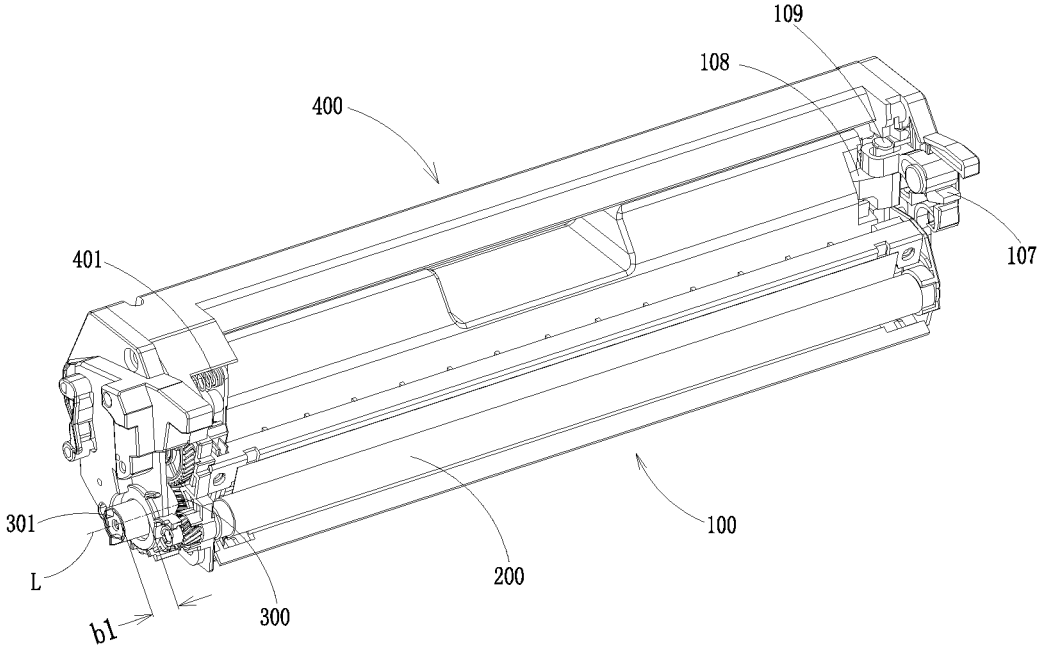
FIG. 18 is a schematic view showing the toner cartridge sliding to the outermost position relative to the bracket in the direction of the rotation axis L.

When ready for development, the image forming apparatus pushes the first stopper 101 and the second stopper 102 to move forward, and the first stopper 101 and the second stopper 102 drive the bracket 400 and the toner cartridge to move forward by compressing the first spring 103 and the second spring 104, respectively. When the developer roller comes into contact with the photosensitive drum provided on the image forming apparatus, the toner cartridge and the bracket stop moving. At this time, one end (the free end) of the slider 107 not in contact with the slider spring comes into contact with the image forming apparatus, so that the slider 107 starts to compress the slider spring 402, and the slider 107 drives the rotation shaft for movable rod to move through the ferrule, forcing the first movable rod 108 rotates about the rotation shaft for movable rod, and the distance between two oppositely disposed ends of the transverse rods of the first movable rod 108 and the second movable rod 109 starts to become larger. The first movable rod 108 has an outer end abutted against the toner cartridge, and the transverse rod of the second movable rod 109 has an outer end abutted against the side wall of the bracket. Since the side wall of the bracket is relatively fixed, the first movable rod 108 pushes the toner cartridge 100 in a direction close to the power portion of the image forming apparatus. When the slider 107 is pushed to the rear side of the bracket 400 (away from the toner cartridge), that is, when the slider spring 402 is at the maximum compression amount, the distance between two oppositely disposed ends (two ends of the outer sides) of the transverse rods of the first movable rod 108 and the second movable rod 109 becomes the largest, and the included angle between the first movable rod 108 and the second movable rod 109 is the largest. The toner cartridge 100 is pushed closest to the power portion of the image forming apparatus, and the driving force receiving assembly 300 is on the side closest to the power portion of the image forming apparatus, and the driving force receiving head 301 and the power portion of the image forming apparatus may be engaged (FIG. 18).

After the imaging is finished, when the image forming apparatus pushes the first stopper 101 and the second stopper 102 to move backward, the driving force receiving head is still engaged with the power portion of the image forming apparatus and is not movable. The first stopper 101 and the second stopper 102 are displaced in the direction perpendicular to the rotation axis L, the slider 107 moves away from the bracket, and drives the rotation shaft for movable rod (the vertical rod of the second movable rod 109) to move, thereby driving the first movable rod 108 rotates about the rotation shaft for movable rod, so that the distance between two oppositely disposed ends of the first movable rod 108 and the second movable rod 109 starts to become smaller, and the toner cartridge starts to move away from the power portion of the image forming apparatus. When the toner cartridge 100 is away from the power portion of the image forming apparatus to the maximum position, the driving force receiving head 301 and the power portion of the image forming apparatus are disengaged. As the image forming apparatus continues to push, the first stopper 101 and the second stopper 102 push the toner cartridge 100 to move backward by the first locking portion 105 and the second locking portion 106, respectively, to separate the developer roller 200 from the photosensitive drum provided on the image forming apparatus.

The embodiment can also perform related variations, for example, the toner cartridge displacement assembly and the driving force receiving assembly are provided on the same side. When the process cartridge is mounted in the image forming apparatus and the imaging operation has not been started, the slider spring 402 drives the slider 107 to a position closest to the rear side of the bracket 400, the distance between two oppositely disposed ends of the transverse rods of the first movable rod 108 and the second movable rod 109 is the largest, and the toner cartridge is located on one side away from the power portion of the image forming apparatus, and the driving assembly 300 provided on the toner cartridge 100 is away from the power portion of the image forming apparatus, and the driving force receiving head 301 is separated from the power portion of the image forming apparatus. When ready for development, the image forming apparatus pushes the first stopper 101 and the second stopper 102 to move forward, and drives the bracket 400 and the toner cartridge to move forward by compressing the first spring 103 and the second spring 104. When the toner cartridge moves forward, the slider 107 compresses the slider spring 402 and drives the rotation shaft for movable rod to move, so that the distance between two oppositely disposed ends of the transverse rods of the first movable rod 108 and the second movable rod 109 starts to become smaller. The toner cartridge 100 is pushed closest to power portion of the image forming apparatus, and the driving force receiving assembly 300 is also closest to one side of the power portion of the image forming apparatus, and the driving force receiving head 301 can be engaged with the power portion on the image forming apparatus.

Alternatively, the toner cartridge displacement control assembly is provided between the side walls of two ends of the toner cartridge and the brackets, and the movement process of the slider of the toner cartridge displacement control assembly on the same side as the driving force receiving assembly and the first and second movable rods is opposite to the movement process of the slider of the toner cartridge displacement control assembly provided on the opposite side to the driving force receiving assembly and the first and second movable rods. That is, when the distance between two oppositely disposed ends of the transverse rods of the first movable rod and the second movable rod of the toner cartridge displacement control assembly provided on the same side of the driving force receiving assembly is the largest, the distance between two oppositely disposed ends of the transverse rods of the first movable rod and the second movable rod of the toner cartridge displacement control assembly provided on the opposite side to the driving force receiving assembly is the smallest. At this time, the toner cartridge is farthest from the power portion of the image forming apparatus, the driving force receiving head and the power portion of the image forming apparatus are disengaged. When the distance between two oppositely disposed ends of the first movable rod and the second movable rod of the toner cartridge displacement control assembly provided on the same side of the driving force receiving component is the smallest, the distance between two oppositely disposed ends of the first movable rod and the second movable rod of the toner cartridge displacement control assembly on the opposite side to the driving force receiving assembly is the largest. At this time, the toner cartridge is closest to the power portion of the image forming apparatus, and the driving force receiving head and the power portion of the image forming apparatus are engaged. When the toner cartridge displacement control assembly is provided between the side walls of two ends of the toner cartridge and the brackets, the toner cartridge movable spring may not be provided.

Embodiment 4

The difference between this embodiment and Embodiment 3 is only the shape of the second movable rod in the toner cartridge displacement control assembly, and the rotation shaft for movable rod is fixedly provided on the slider 107 and moves with the slider. The second movable rod 109 has a rod shape, and has one end (a free end) freely in contact with the bracket 400 (which is also movably provided on the bracket 400 by a hinge) and another end sleeved on the rotation shaft for movable rod provided on the slider 107 and rotatable about the rotation shaft for movable rod. One end of the first movable rod 108 is sleeved on the rotation shaft for movable rod and rotatable about the rotation shaft for movable rod and the other end (the free end) of the first movable rod 108 is in contact with the side wall of the toner cartridge 100. The axis of the rotation shaft for movable rod is perpendicular to the rotation axis L and perpendicular to the moving direction of the slider.

Referring to FIGS. 15*a*, 15*b*, 16, and 17, the movement relationship between the slider and the first and second movable rods can be understood. Referring to FIGS. 15*a* and 16, when the slider 107 is pushed by the slider spring 402 to the maximum position away from the bracket 400, a certain included angle is formed between the first movable rod 108 and the second movable rod 109, and the distance between two oppositely disposed ends (outer ends) of the first moveable rod 108 and the second movable rod 109 is L1. When the slider 107 moves toward the inner side of the bracket 400, the slider spring 402 is compressed, and the first movable rod 108 and the second movable rod 109 are driven to rotate around the rotation shaft for movable rod by the slider 107. With the movement of the slider 107, the distance between two oppositely disposed ends of the first movable rod 108 and the second movable rod 109 gradually becomes larger. When the slider 107 reaches the position closest to the bracket 400, the distance between two oppositely disposed ends of the first movable rod 108 and the second movable rod 109 becomes the largest, which is L2, L2>L1, with reference to FIG. 15*b* and FIG. 17.

When the process cartridge is mounted in the image forming apparatus and the imaging operation has not been started, the slider 107 is farthest from the bracket 400 under the pushing of the slider spring 402, and the distance between two oppositely disposed ends of the first movable rod 108 and the second movable rod 109 is the smallest. At this time, the toner cartridge 100 is located on one side away from the power portion of the image forming apparatus under the pushing of the toner cartridge movable spring 401. The driving assembly 300 provided on the toner cartridge 100 is also away from the power portion of the image forming apparatus, and the driving force receiving head 301 and the power portion of the image forming apparatus are separated (FIG. 13).

When ready for development, the image forming apparatus pushes the first stopper 101 and the second stopper 102 to move forward, and the first stopper 101 and the second stopper 102 drive the bracket 400 and the toner cartridge to move forward by compressing the first spring 103 and the second spring 104 respectively. When the developer roller comes into contact with the photosensitive drum provided on the image forming apparatus, the toner cartridge and the bracket stop moving. At this time, one end (a free end) of the slider 107 not contacting the slider spring is in contact with the image forming apparatus, so that the slider 107 starts to compress the slider spring 402, and the first movable rod 108 and the second movable rod 109 start to rotate under the driving of the slider 107, and the distance between two oppositely disposed ends of the first movable rod 108 and the second movable rod 109 starts to become larger, and the first movable rod 108 has an outer end abutted against the toner cartridge, and the second movable rod 109 has an outer end abutted against the side wall of the bracket, pushing the toner cartridge 100 to move in a direction close to the power portion of the image forming apparatus. When the slider 107 is pushed closest to the rear side of the bracket 400 (away from the toner cartridge), the distance between two oppositely disposed ends (the outer ends) of the first movable rod 108 and the second movable rod 109 becomes the largest, the toner cartridge 100 is pushed closest to the power portion of the image forming apparatus, and the driving force receiving assembly 300 is also closest to one side of the power portion of the image forming apparatus, and the driving force receiving head 301 and the power portion on the image forming apparatus can be engaged (FIG. 18).

After the imaging is finished, when the image forming apparatus pushes the first stopper 101 and the second stopper 102 to move backward, the driving force receiving head is still engaged with the power portion of the image forming apparatus and cannot move. The first stopper 101 and the second stopper 102 are displaced in the direction perpendicular to the rotation axis L, the slider 107 moves in the direction away from the bracket, and drives the first movable rod 108 and the second movable rod 109 to rotate about the rotation shaft, so that the distance between two oppositely disposed ends of the first movable rod 108 and the second movable rod 109 starts to become smaller, and the toner cartridge starts to move away from the power portion of the image forming apparatus. When the toner cartridge 100 is away from the power portion of the image forming apparatus to the maximum position, the driving force receiving head 301 and the power portion of the image forming apparatus are disengaged, and as the image forming apparatus continues to push, the first stopper 101 and the second stopper 102 push the toner cartridge 100 to move backward through the first locking portion 105 and the second locking portion 106, respectively, to separate the developer roller 200 from the photosensitive drum provided on the image forming apparatus.

Related variations can be made to this embodiment, for example, the toner cartridge displacement assembly and the driving force receiving assembly are provided on the same side. When the process cartridge is mounted in the image forming apparatus and the imaging operation has not been started, the slider spring 402 drives the slider 107 to be located closest to the rear side of the bracket 400. The distance between two oppositely disposed ends of the first movable rod 108 and the second movable rod 109 is the largest, and the toner cartridge is located on one side away from the power portion of the image forming apparatus, and the driving assembly 300 provided on the toner cartridge 100 is also away from the power portion of the image forming apparatus, and the driving force receiving head 301 is separated from the power portion of the image forming apparatus. When ready for development, the image forming apparatus pushes the first stopper 101 and the second stopper 102 to move forward, and the bracket 400 and the toner cartridge are driven to move forward by compressing the first spring 103 and the second spring 104. When the toner cartridge moves forward, the slider 107 compresses the slider spring 402, so that the distance between two oppositely disposed ends of the first movable rod 108 and the second movable rod 109 starts to become smaller, and the toner cartridge 100 is pushed to the position closest to the image forming apparatus, the driving force receiving assembly 300 is also closest to the one side of the power portion of the image forming apparatus, and the driving force receiving head 301 and the power portion of the image forming apparatus can be engaged Alternatively, a toner cartridge displacement control assembly is provided between the each of the side walls of two ends of the toner cartridge and the bracket, and the movement process of the slider of the toner cartridge displacement control assembly on the same side as the driving force receiving assembly and the first and second movable rods is opposite to the movement process of the slider of the toner cartridge displacement control assembly provided on the opposite side to the driving force receiving assembly and the first and second movable rods. That is, when the distance between two oppositely disposed ends of the transverse rods of the first movable rod and the second movable rod of the toner cartridge displacement control assembly provided on the same side as the driving force receiving assembly is the largest, the distance between two oppositely disposed ends of the transverse rods of the first movable rod and the second movable rod of the toner cartridge displacement control assembly provided on the opposite side to the driving force receiving assembly is the smallest. At this time, the toner cartridge is farthest from the power portion of the image forming apparatus, the driving force receiving head and the power portion of the image forming apparatus are disengaged. When the distance between two oppositely disposed ends of the first movable rod and the second movable rod of the toner cartridge displacement control assembly provided on the same side of the driving force receiving component is the smallest, the distance between two oppositely disposed ends of the first movable rod and the second movable rod of the toner cartridge displacement control assembly on the opposite side to the driving force receiving assembly is the largest. At this time, the toner cartridge is closest to the power portion of the image forming apparatus, and the driving force receiving head and the power portion of the image forming apparatus are engaged. When the toner cartridge displacement control assembly is provided between the side wall of two ends of the toner cartridge and the bracket, the toner cartridge movable spring may not be provided.

The above description of the disclosed embodiments enables those skilled in the field to make or use the present application. Various modifications to these embodiments will be apparent to those skilled in the field, such as combining the structures of Embodiment 2 or 3, or 2 and 4, the free end of the pendulum rod in Embodiment 2 is fixed to the slider 107 of Embodiment 3, the slider 107 is moved by the swing of the pendulum rod to realize the axial movement of the toner cartridge along the axial direction of the driving force receiving assembly relative to the bracket. In addition, the general principles defined herein may be implemented in other embodiments without departing from the spirit or scope of the present application. Therefore, the present application is not intended to be limited to the embodiments shown herein, but is to be accorded with the broadest scope of the principles and novel features disclosed herein.

The invention claimed is:

1. A process cartridge detachably mountable in an image forming apparatus, comprising:

a toner cartridge for accommodating a developer;

a developer roller; and a driving force receiving assembly for receiving a driving force of the image forming apparatus and driving the developer roller to rotate;

wherein the process cartridge further comprising a first stopper and a second stopper provided at a bottom of the toner cartridge, and the first stopper and the second stopper being movable relative to the toner cartridge in a direction perpendicular to an axial direction of the driving force receiving assembly; and when the first stopper and/or the second stopper move, a driving force receiving head of the driving force receiving assembly is movable in the axial direction of the driving force receiving assembly.

2. The process cartridge according to claim 1, wherein when the first stopper or the second stopper moves forward relative to the toner cartridge, the driving force receiving head of the driving force receiving assembly extends outward in the axial direction of the driving force receiving assembly; and when the first stopper or the second stopper moves backward relative to the toner cartridge, the driving force receiving head of the driving force receiving assembly retracts inward in the axial direction of the driving force receiving assembly.

3. The process cartridge according to claim 2, wherein the first stopper is provided on one side wall in an axial direction of the toner cartridge by a rotation shaft, and the side wall of the toner cartridge is further provided with a first locking portion, and a first spring is provided between the first stopper and the toner cartridge, and the first spring is in a pre-compressed state, so that the first stopper is abutted against the first locking portion; when there is an external force which makes the first stopper overcome a pre-compression force of the first spring, the first stopper separates from the first locking portion and rotates forward relative to the toner cartridge about the rotation shaft, and further compresses the first spring; and the second stopper is provided on the other side wall in the axial direction of the toner cartridge by the rotation shaft, and the other side wall of the toner cartridge is provided with a second locking portion, and a second spring is further provided between the second locking portion and the toner cartridge, and the second spring is in the pre-compressed state, so that the second stopper is abutted against the second locking portion; when there is an external force which makes the second stopper overcome the pre-compression force of the second spring, the second stopper separates from the second locking portion and rotates forward relative to the toner cartridge about the rotation shaft, and further compresses the second spring.

4. The process cartridge according to claim 1, wherein the driving force receiving assembly comprises the driving force receiving head, a return spring, a driving block, a driving gear, a positioning bracket, and a position-limiting bracket;

the positioning bracket and the driving gear are fixed relative to the toner cartridge in the axial direction of the driving force receiving assembly, and the first stopper is connected to the positioning bracket by a connection rod, and the positioning bracket is driven to rotate about the axial direction of the driving force receiving assembly by the connection rod;

the position-limiting bracket is provided on the positioning bracket, and the positioning bracket has a pushing protrusion portion protruded in the axial direction of the driving force receiving assembly, and the pushing protrusion portion has a movement slope connecting a top surface of the positioning bracket and the top surface of the pushing protrusion portion, a protrusion portion abutted against the positioning bracket is provided at the bottom of the position-limiting bracket, when the positioning bracket rotates about the axial direction of the driving force receiving assembly, the protrusion portion of the position-limiting bracket moves between the top surface of the positioning bracket and the top surface of the pushing protrusion portion along the movement slope; and the driving block is provided on the position-limiting bracket, and the driving gear is sleeved outside the driving block, and the driving force receiving head passes through the driving gear and the driving block, and extends into the position-limiting bracket, the return spring is sleeved outside the driving force receiving head, and the return spring has one end abutted against the driving gear and another end abutted against the driving block.

5. The process cartridge according to claim 4, wherein the pushing protrusion portion is provided at an outer edge of the positioning bracket.

6. The process cartridge according to claim 4, wherein the first stopper and the second stopper, under a pushing of the imaging forming apparatus, drive the toner cartridge and the developer roller to move.

7. A process cartridge detachably mountable in an image forming apparatus, comprising:

a toner cartridge for accommodating a developer;

a developer roller; and a driving force receiving assembly for receiving a driving force of the image forming apparatus and driving the developer roller to rotate;

wherein the process cartridge further comprising:

a bracket, the toner cartridge being movably provided at the bracket in an axial direction of the driving force receiving assembly; and a first stopper and a second stopper provided on the bracket, the first stopper and the second stopper being movable relative to the bracket in a direction perpendicular to the axial direction of the driving force receiving assembly; and when the first stopper and/or the second stopper move, the toner cartridge is movable relative to the bracket in the axial direction of the driving force receiving assembly.

8. The process cartridge according to claim 7, wherein when the first stopper and/or the second stopper move, the toner cartridge approaches to or is away from a power portion of the image forming apparatus relative to the bracket in the axial direction of the driving force receiving assembly.

9. The process cartridge according to claim 8, wherein when the first stopper and/or the second stopper move forward relative to the toner cartridge, the toner cartridge approaches to the power portion of the image forming apparatus in the axial direction of the driving force receiving assembly; and when the first stopper and/or the second stopper move backward relative to the toner cartridge, the toner cartridge is away from the power portion of the image forming apparatus in the axial direction of the driving force receiving assembly.

10. The process cartridge according to claim 7, wherein a toner cartridge movable spring is provided between at least one side wall of the toner cartridge and the bracket, and the toner cartridge movable spring enables the toner cartridge to approach to or move away from the power portion of the image forming apparatus.

11. The process cartridge according to claim 10, wherein the first stopper is connected with a first pendulum rod, and the first stopper and the first pendulum rod are connected with one side wall in the axial direction of the bracket by a rotation shaft, a first spring is provided between the first stopper and the toner cartridge, and two ends of the first spring are respectively abutted against the first stopper and the bracket; and the second stopper is connected with a second pendulum rod, and the second stopper and the second pendulum rod are connected with the other side wall in the axial direction of the bracket by a rotation shaft, a second spring is provided between the second spring and the bracket, and two ends of the second spring are respectively abutted against the second stopper and the bracket.

12. The process cartridge according to claim 11, wherein a first gap is provided between the side wall of the bracket provided with the first stopper and the side wall of the toner cartridge on the same side; a second gap is provided between the side wall of the bracket provided with the second stopper and the side wall of the toner cartridge on the same side; and when the first stopper rotates, the first pendulum rod is driven to wedge into or exit the first gap, and when the second stopper rotates, the second pendulum rod is driven to wedge into or exit the second gap.

13. The process cartridge according to claim 12, wherein when the first pendulum rod wedges into the first gap, the second pendulum rod exits the second gap; and when the second pendulum rod wedges into the second gap, the first pendulum rod exits the first gap.

14. The process cartridge according to claim 9, further comprising a toner cartridge displacement control assembly which is provided between the side wall of the toner cartridge and the bracket, wherein the toner cartridge displacement control assembly comprises a slider, a first movable rod, a second movable rod and a slider spring;

the slider spring has one end fixed on the bracket and another end connected to the slider, when there is an external force which makes the slider overcome the elastic force of the slider spring, the slider is movable relative to the side wall of the bracket;

the slider is further connected with a rotation shaft for movable rod, and the first movable rod and the second movable rod are rotatably connected to the rotation shaft for movable rod, one end of the first movable rod away from the rotation shaft for movable rod is in contact with or hinged with the side wall of the toner cartridge, and one end of the second movable rod away from the rotation shaft for movable rod is in contact with or hinged with the bracket; and when the slider drives the rotation shaft for movable rod to move, an included angle between the first movable rod and the second movable rod is changed to drive the toner cartridge to move axially relative to the bracket.

15. The process cartridge according to claim 14, wherein when the slider spring is in an initial state, the included angle between the first movable rod and the second movable rod is the smallest; and when the slider spring is subjected to an external force to generate a maximum deformation amount, the included angle between the first movable rod and the second movable rod is the largest.

16. The process cartridge according to claim 15, wherein the toner cartridge displacement control assembly is provided between an axial side wall of the toner cartridge away from the driving force receiving assembly and the bracket.

17. The process cartridge according to claim 16, wherein the toner cartridge movable spring is provided between the axial side wall of the toner cartridge mounted with the driving force receiving assembly and the bracket.

18. The process cartridge according to claim 15, wherein the toner cartridge displacement control assembly is provided between each of two axial side walls of the toner cartridge and the bracket, and the toner cartridge displacement control assembly on the same side as the driving force receiving assembly is a first control assembly, and the toner cartridge displacement control assembly on an opposite side of the driving force receiving assembly is a second control assembly; and when the first movable rod and the second movable rod of the first control assembly are in a state of the largest included angle, the first movable rod and the second movable rod of the second control assembly are in a state of the smallest included angle; and when the first movable rod and the second movable rod of the first control assembly are in the state of the smallest included angle, the first movable rod and the second movable rod of the second control assembly are in the state of the largest included angle.

19. The process cartridge according to claim 18, wherein the first stopper is connected with the first pendulum rod, the second stopper is connected with the second pendulum rod, and the first pendulum rod and the second pendulum rod are respectively connected to the sliders of the toner cartridge displacement control assembly on the respective side;

when the first stopper rotates, the first pendulum rod is driven to rotate to drive the slider of the toner cartridge displacement control assembly on the corresponding side to move; and when the second stopper rotates, the second pendulum rod is driven to rotate to drive the slider of the toner cartridge displacement control assembly on the corresponding side to move.

20. The process cartridge according to claim 15, wherein the second movable rod is integrally formed with the rotation shaft for movable rod to form a T-shaped rod, a vertical rod of the T-shaped rod is the rotation shaft for movable rod, and an end of a transverse rod of the T-shaped rod is hinged to the bracket; the slider is provided with a ferrule which is sleeved on the rotation shaft for movable rod, and the slider drives the rotation shaft for movable rod to move.

21. The process cartridge according to claim 15, wherein the rotation shaft for movable rod is fixedly provided on the slider and moves with the slider; one end of the second movable rod is sleeved on the rotation shaft for movable rod and rotatable about the rotation shaft for movable rod; and one end of the first movable rod is sleeved on the rotation shaft for movable rod and rotatable about the rotation shaft for movable rod.

22. The process cartridge according to claim 15, wherein an axis of the rotation shaft for movable rod is perpendicular to an axis of the driving force receiving assembly and is perpendicular to a moving direction of the slider; and the slider is reciprocally movable in a direction perpendicular to the axial direction of the driving force receiving assembly by the slider spring and an external force.

* * * * *